US006827479B1

(12) United States Patent
Xia et al.

(10) Patent No.: US 6,827,479 B1
(45) Date of Patent: Dec. 7, 2004

(54) UNIFORM SMALL PARTICLE HOMOGENIZER AND HOMOGENIZING PROCESS

(75) Inventors: Frank Zhishi Xia, South El Monte, CA (US); Mary Ziping Luo, South El Monte, CA (US); Jack Yongfeng Zhang, South El Monte, CA (US)

(73) Assignee: Amphastar Pharmaceuticals Inc., Rancho Cucamonga, CA (US)

( * ) Notice: Subject to any disclaimer, the term of this patent is extended or adjusted under 35 U.S.C. 154(b) by 27 days.

(21) Appl. No.: 10/261,552

(22) Filed: Sep. 30, 2002

Related U.S. Application Data

(60) Provisional application No. 60/328,247, filed on Oct. 11, 2001.

(51) Int. Cl.[7] ..... B01F 5/04; B01F 15/02

(52) U.S. Cl. ..... 366/162.4; 366/173.2; 366/176.4; 366/181.8; 366/182.2

(58) Field of Search ..... 366/162.4, 167.1, 366/173.1, 173.2, 176.3, 176.4, 177.1, 179.1, 181.8, 181.1, 182.2; 417/12

(56) References Cited

U.S. PATENT DOCUMENTS 2,463,552 A * 3/1949 Newhall ..... 417/345
3,617,029 A * 11/1971 Breer et al. ..... 366/160.2
4,269,569 A * 5/1981 Hoover ..... 417/5
4,606,709 A * 8/1986 Chisolm ..... 417/347
5,088,898 A * 2/1992 Fukumoto et al. ..... 417/347
5,259,731 A * 11/1993 Dhindsa et al. ..... 417/3
5,368,451 A * 11/1994 Hammond ..... 417/395
5,437,542 A * 8/1995 Ewing ..... 417/258
5,927,852 A * 7/1999 Serafin ..... 366/144

* cited by examiner

*Primary Examiner*—Tony G Soohoo
(74) *Attorney, Agent, or Firm*—Albert O. Cota

(57) ABSTRACT

A uniform small particle homogenizer for liquid product comprising a pair of intensifier cylinder pumps (20) driven by a hydraulic system (22). The pumps have a power stroke side and a suction stroke side, and a pair of proximity sensors (24) that interface with each pump to detect forward and rearward movement. A microprocessor (26) with timing capabilities controls the sequential operation of each pump with the power stroke of each pump timed to alternately produce a flow of the liquid product with a precisely timed flow overlap period from the alternating pumps. Since the power stroke takes a longer time than the suction stroke, the instant each power stroke is started the opposite pump is timed to hesitate and slightly overlap until a constant product flow-rate is produced from the alternating pumps, which eliminates large variances in pressure and therefore achieves uniformity in product particle size.

9 Claims, 6 Drawing Sheets

UNIFORM SMALL PARTICLE HOMOGENIZER AND HOMOGENIZING PROCESS

This application claims benefit of U.S. Provisional 60/328,249 filed Oct. 11, 2001

TECHNICAL FIELD

The invention pertains to homogenizers that generate high pressure in general, and more specifically to a homogenizer that utilizes at least two hydraulically driven cylinder pumps that alternately reciprocate to create a constant pressure and product flow rate.

BACKGROUND ART

Homogenization is a process by which, for the purpose of this invention, a fluid is made more uniform throughout in texture, mixture, quality, etc. by breaking down and blending the particles that comprise the fluid. It is often necessary to homogenize an emulsion, which is a system comprising two immiscible liquid phases, with one hydrophobic "oil" phase dispersed as small particles between 1 nm and 1000 nm in a second hydrophilic "water" phase. Emulsions have come into large-scale use in applications ranging from food and medicine, to industrial material and art supplies.

Previously, many types of homogenizer have been used in endeavoring to provide an effective means to form emulsions. However, the prior art listed below did not disclose any patents that possess the novelty of the instant invention, however the following U.S. patents are considered related:

| U.S. Pat. No. | Inventor | Issue Date |
|---|---|---|
| 4,533,254 | Cook et al. | August 1985 |
| 4,952,067 | Dallas | August 1990 |
| 5,116,536 | Bucheler et al. | May 1992 |
| 5,720,551 | Shechter | February 1998 |
| 5,749,650 | Kinney et al. | May 1998 |
| 5,899,564 | Kinney et al. | May 1999 |
| 6,085,664 | Klinksiek | July 2000 |
| 6,238,080 | Jarchau | May 2001 |

Other Publications

Microfluidics Industrial Pilot Scale Microfluidizer Processors M-700 Series Brochure.

Currently high pressure homogenizers are used to produce small, uniform particles by utilizing a homogenizing valve, orifice or chamber. There are a number of patents covering many types of homogenizing valves, orifices and chambers, each to describing how to obtain small sized particles, to raise efficiency and how to improve particle uniformity.

Cook et al. in U.S. Pat. No. 4,533,254 discloses a high pressure homogenizer with two or more fixed orifices used to run premixed raw emulsion forms into each other. The process is capable of reaching pressures of about 40,000 psi.

Dallas U.S. Pat. No. 4,952,067 discloses a device that comprises a stack of stainless steel disk valves, a design intended as an improvement to those detailed in U.S. Pat. Nos. 2,882,025 and 4,383,769. Dallas teaches this improvement on the older designs in manners of cleanliness while maintaining effectiveness in the creation of the emulsion.

Bucheler et al. in U.S. Pat. No. 5,116,536 discloses a process for the preparation of stable, fine particled dispersions from pre-emulsions prepared by known emulsifying methods. Under the Bucheler et al. process, the pre-emulsion is passed to a pressure release jet, which operates at technologically optimal conditions allowing the use of lower pressures and improving the economics of the known process.

Shechter in U.S. Pat. No. 5,720,551 discloses a method where a structure in the path of a jet of fluid controls the flow of one fluid component into a stagnant supply of a second fluid component to cause shear and cavitation in the fluid interface.

Kinney et al. in U.S. Pat. Nos. 5,749,650 and 5,899,564 discloses a homogenization valve designed to improve homogenization efficiency.

Klinksiek in U.S. Pat. No. 6,085,664 discloses a process for homogenizing milk with a high-pressure homogenizer that uses a small valve aperture to allow for higher throughput and/or volume flow with a lower pressure.

Jarchau in U.S. Pat. No. 6,238,080 discloses a homogenizing valve through which the fluid crosses from an outside high-pressure volume to a central low-pressure volume and an actuator controls the width of the gap with the transition homogenizing the fluid.

In addition to the types of homogenizing valves, orifices and chambers, the power sources that are used in the homogenization process also play an important role in acquiring small particle size and raising performance efficiency. Whether single pump or multi-pump systems, the previously disclosed technologies do not establish a flow overlap to maintain a constant pressure that yields a substantially uniform particle distribution. The uniformity provided by the inventive homogenizer greatly decreases the variation in particle size, which improve emulsion quality.

Some commercially available homogenizers provide at least two intensifier pumps, which may be operated with either independent product streams of the same product. The term "power stroke" is used to describe the motion of the pump, where the product is forced to go through an interaction chamber that moves from a high pressure to a low pressure, thus breaking down the "oil" phase into smaller droplets. The term "suction stroke" is used to describe the motion that introduces product into the intensifier pumps.

One example of the use of two intensifier pumps utilizes one motor to operate two independent hydraulic pumps and hydraulic systems, which include valves and cylinders etc. The hydraulic cylinders are directly connected to single-acting intensifier pumps that amplify the high hydraulic pressure to the cylinder to reach a higher product stream pressure in the intensifier pumps. At the beginning of the power stroke the product stream flow-rate increases form zero to a constant value. The flow-rate remains constant during most of the power stroke. At the end of the power stroke the product stream flow-rate decreases and finally becomes zero. At the zero flow rate, the intensifier pump reverses its direction and fresh product is drawn into the pump. At the end of the suction stroke the pump again reverses direction and a new power stroke begins. During the power stroke period the product is forced out of the pump. Each pump has its own interaction chamber in which the product accelerates to two high velocity streams that then collide with each other, thus creating shear and impact forces within the product stream, which brings about the immiscible emulsions.

The quality and stability of emulsions depend upon the average particle size and size distribution. An emulsion consists of two immiscible liquid phases consisting of one "oil" phase suspended within a second "water" phase. In an emulsion the oil phase particles or droplets strike each other due to Brownian motion or shaking. The particles will continue to strike each other and merge into particles of increasing size. The larger the particles are that collide, the larger the resulting particles will be when formed as a result of the merging process. The frequency of the collisions combined with the resulting larger particle sizes deteriorates the quality of the product.

One way to reduce the size of the oil particles is to let the product pass through the homogenizer several times, however this technique yields low efficiency during processing and the average size of the particles may become too small.

The particle size depends upon the shear and impact forces in the interaction chamber, however both the shear forces and impact forces depend on the product stream velocities which in turn depend on the flow-rate of the product stream. A low product stream flow-rate will create a minimal velocity which yields particles with large diameters. In this low-product stream flow rate, the power stroke will always contain ramp up (at the beginning) and ramp down (at the end) periods with slower flow-rates.

DISCLOSURE OF THE INVENTION

The invention discloses a homogenizer and a homogenization process that overlaps the end of one intensifier pump power stroke with the beginning of another intensifier pump power stroke. Both of the pumps are configured to share one interaction chamber since the flow of each pump enters a single interaction chamber and the power strokes are precisely arranged so that the homogenizer maintains a high pressure and a high product flow-rate throughout the pump cycles. Alternating the two pumps with appropriate timing will therefore reduce flow-rate variance, thus removing any decreases in flow-rate or product flow.

The primary object of the invention is described using the relationship that two sides of a hydraulic cylinder have different working areas, the power stroke takes a longer time to complete than the suction stroke. Two proximity sensors are therefore installed in each intensifier pump to detect their position. Once started, pump one begins to move forward in the power stroke, while pump two remains at rest. When pump one activates the first sensor, a timer in a microprocessor starts and pump two begins to move forward. When the timer reaches a predetermined time duration, pump one changes direction and brings in product during the suction stroke. When pump one activates the second sensor, pump one stops. Since a pump moving in the power stroke takes more time than required for the suction stroke plus the time differential, pump two remains moving forward in the power stroke. When the timer reaches a predetermined differential, pump two changes its direction and begins the suction stroke. When pump two activates the second sensor it stops and waits for pump one to activate the first sensor. The cycle will continue to alternate until the whole process is stopped. After stopping, the first sensors activated by the pumps, will activate the timer but will no longer activate the other pump, which will come to rest.

These and other objects of the present invention will become apparent from the subsequent detailed description of the preferred embodiment and the appended claims taken in conjunction with the accompanying drawings.

BEST MODE FOR CARRYING OUT THE INVENTION

Figure 1:
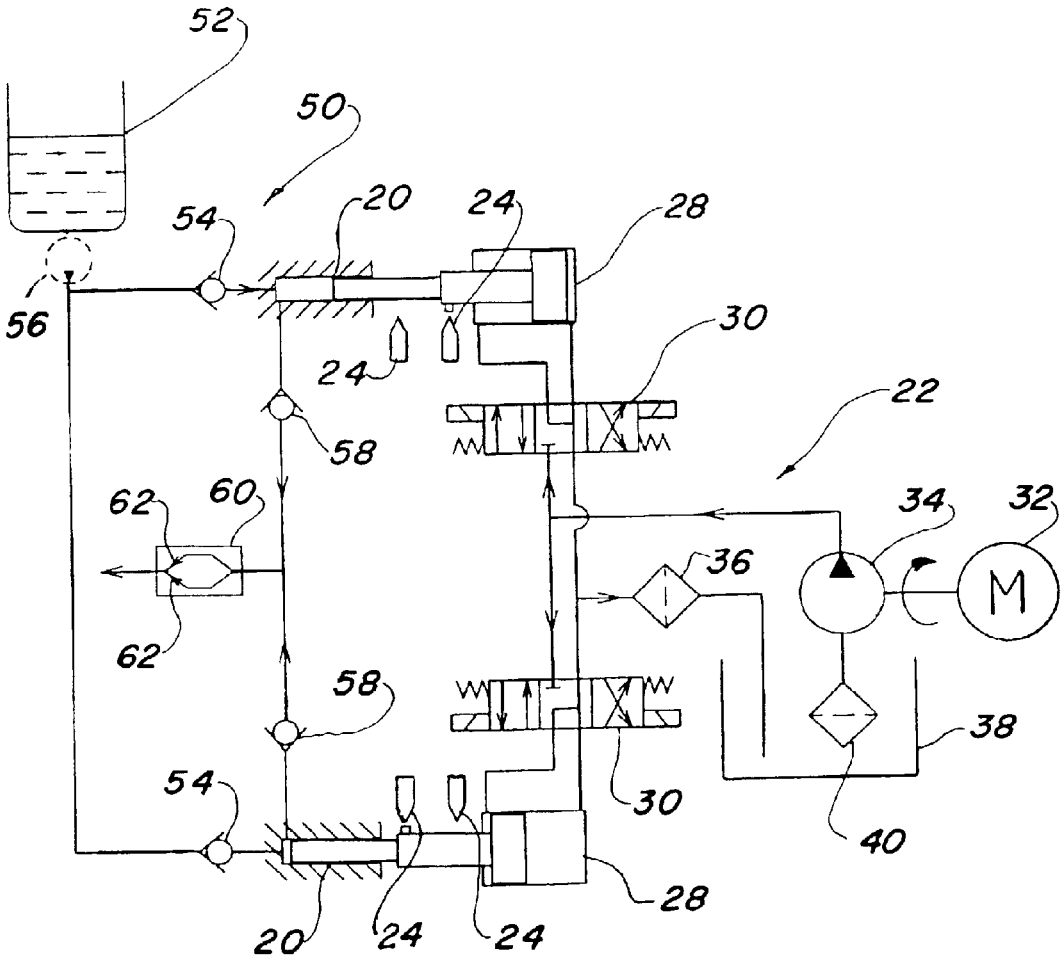
FIG. 1 is a homogenizer flow diagram.

The best mode for carrying out the invention is presented in terms of a preferred embodiment for a homogenizer and a homogenizing process. The preferred embodiment as shown in FIGS. 1 through 6, comprised of a pair of intensifier cylinder pumps 20 that are driven by a hydraulic system 22, with each cylinder pump 20 having a power stroke and a suction stroke. As a result of the construction of a basic hydraulic cylinder each side has a different working area. A pair of proximity sensors 24 interface with each intensifier cylinder pump 20 to detect the forward and rearward movement of the respective cylinder pump 20.

A microprocessor 26 having timing capabilities controls the sequential operation of each intensifier cylinder pump 20 such that the power stroke of each cylinder pump 20 is timed to alternately produce a flow of product through the pump. The invention provides a novel, precisely timed flow overlap period from the alternating pumps 20, since the power stroke of each pump takes a longer time period than the suction stroke. The microprocessor 26 controls the precise timing of each power stroke to allows a constant product flow-rate to be produced thus allowing the alternating intensifier cylinder pumps 20 to eliminate large variances in pressure to achieving uniformity in the size of the product particle.

In order to accomplish the above process control the following detailed description of the homogenizer invention is presented.

Figure 2:
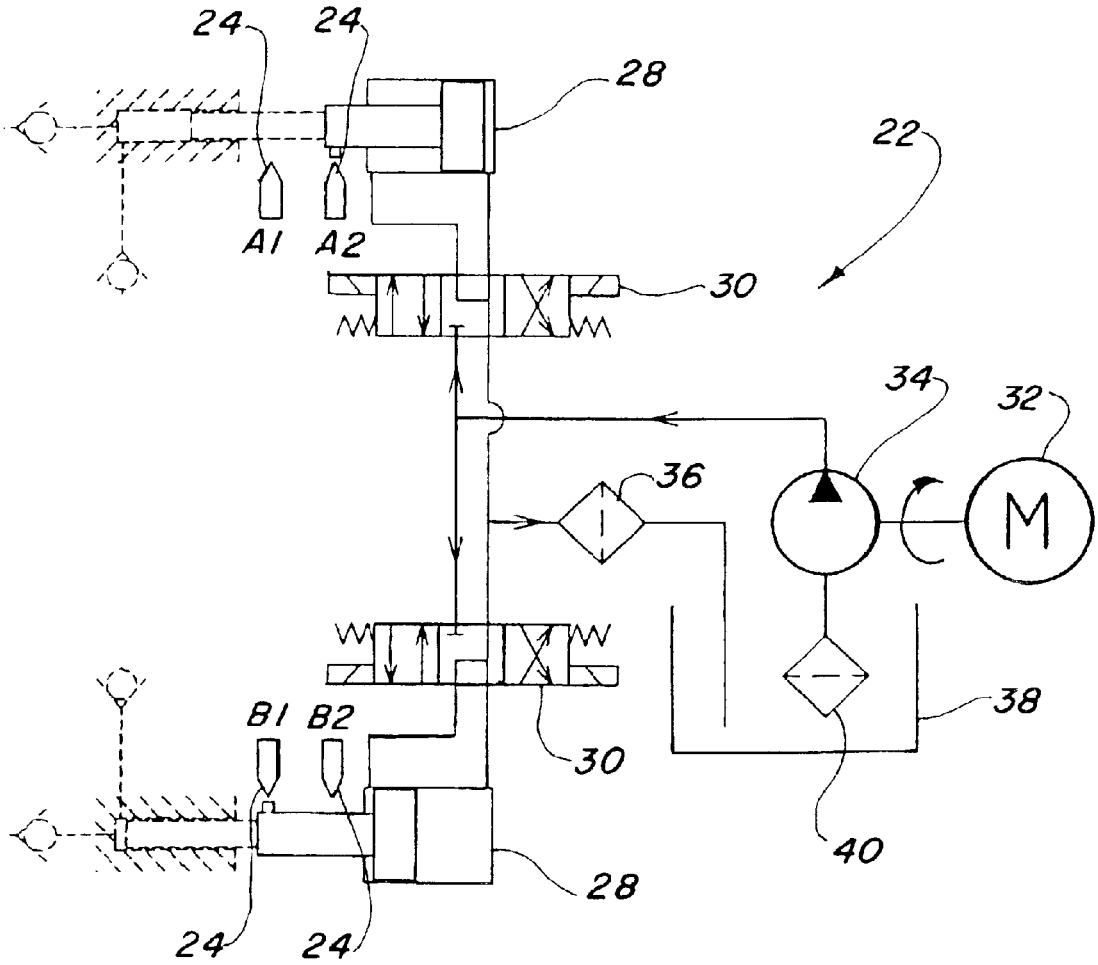
FIG. 2 is a hydraulic flow diagram.

The hydraulic system 22 comprises two separate, partially duplicated arrangements, with one for each intensifier cylinder pump 20; each are preferably the open loop type utilizing a pair of hydraulic cylinders 28 with a direction control valve 30 in communication with each hydraulic cylinder 28. The valves 30 are of the four-way sliding bobbin type having an off position and two opposed direction positions that activate each cylinder 28 in an opposed reciprocating sequence. FIG. 2 illustrates the entire hydraulic system 22 with the intensifier cylinder pumps 20 shown dotted. The hydraulic system 22 includes a hydraulic pump motor 32 which drives a variable displacement hydraulic pump 34 in fluid communication through a supply line to each hydraulic cylinder 28. A return line strainer 36 located within a hydraulic return line from each direction control valve 30 drains into a reservoir 38 that collects hydraulic fluid from the hydraulic cylinder return lines. A supply line strainer 40 is provided between the inlet of the hydraulic pump 34 and the reservoir 38.

Figure 4:
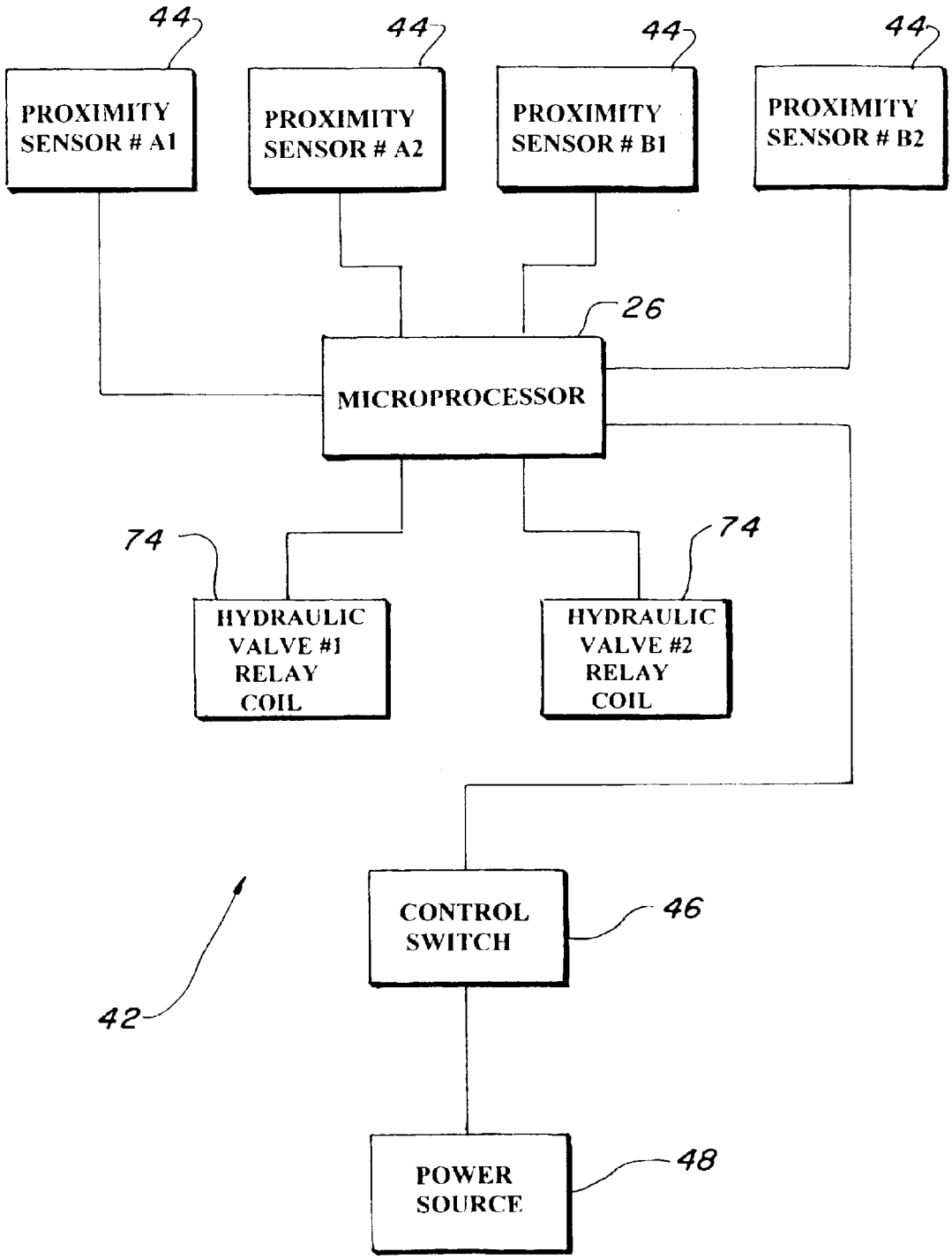
FIG. 4 is an electronic control circuit block diagram.

An electronic microprocessor control system 42, as illustrated in FIG. 4, is provided for monitoring and regulating the timing of the reciprocating sequence of the hydraulic cylinders 28. The control system consists of a microprocessor 26 that regulates the reciprocating sequence of the hydraulic cylinders 28 by cycling the direction control valves 30. A pair of proximity sensors 24 detects the position of each hydraulic cylinder and signals the microprocessor 26 to energize the hydraulic cylinders 28 at a precise interval to produce a constant flow of the pressurized product and to optimize flow overlap. The proximity sensors 24 are designated A1 and A2 for the first hydraulic cylinder 28, and B1 and B2 for the second hydraulic cylinder 28. A control switch 46 is provided for the electronic microprocessor control system 42 and a power source 48 is required for operation.

Figure 3:
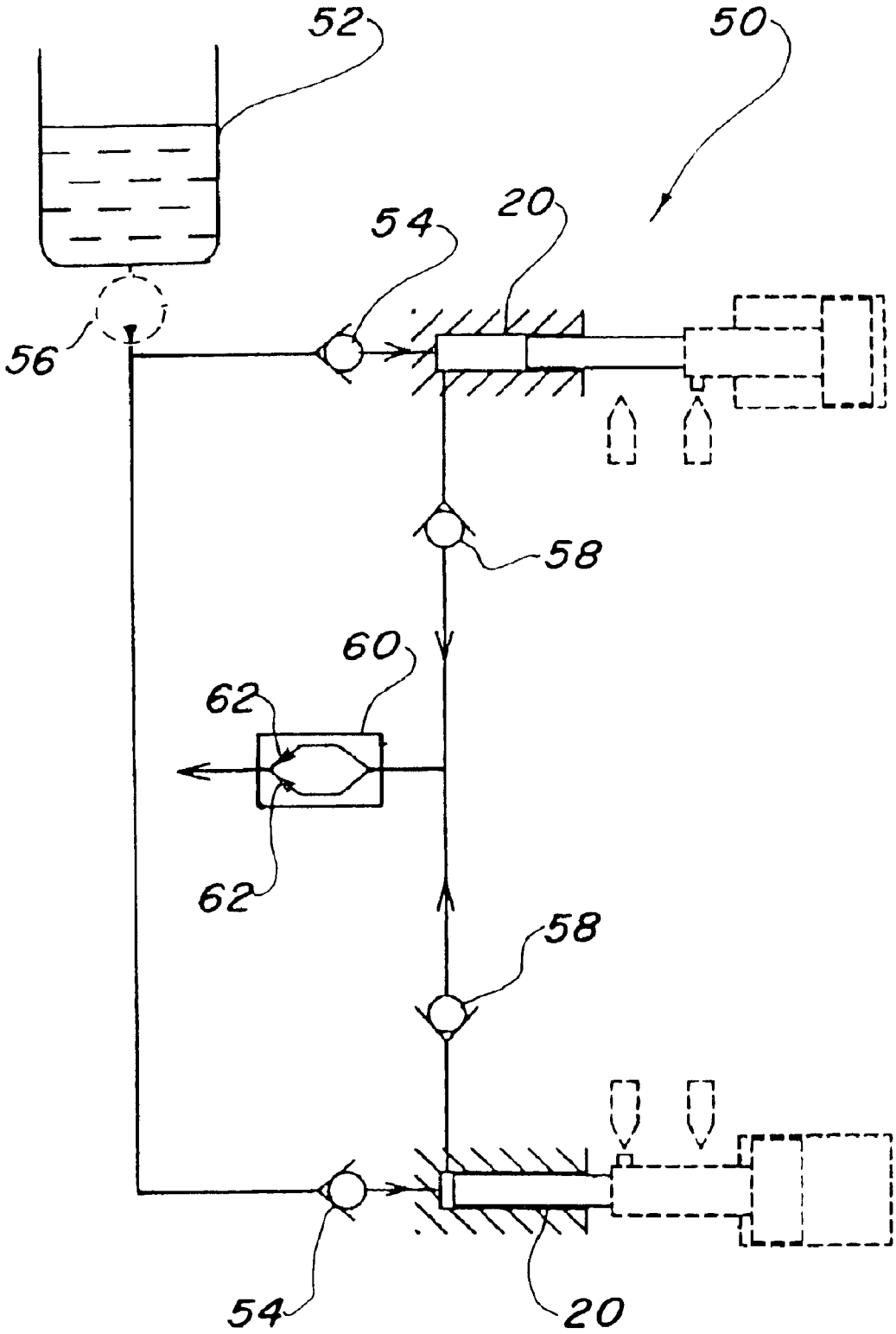
FIG. 3 is a product flow diagram.

The product system 50, as depicted schematically in FIG. 3, includes the single acting product flow intensifier cylinder pumps 20 that are rigidly affixed onto the end of the piston rod of each hydraulic cylinder 28. When the hydraulic cylinder 28 reciprocates, linear action is transferred to the intensifier cylinder pump 20. Since the flow intensifier cylinder pump 20 has a smaller working area than the single acting hydraulic cylinder a pressure increase is achieved.

A product reservoir 52 is provided in the product system 50 that is in fluid communication through an inlet check valve 54 to each product flow intensifier cylinder pump 20 to provide the product into the system 50.

An optional delivery transfer pump 56, as shown with broken lines in FIGS. 1 and 3, may be added to the product system 50. The pump 56 is in communication with both the product reservoir 52 and each inlet check valve 54 for increasing inlet pressure to the intensifier cylinder pump 20 which is utilized to overcome line pressure loss and also the resistance of the inlet check valve 54.

An outlet check valve 58 is connected to each intensifier cylinder pump 20 which transforms the basic cylinder into a pump. This combination creates the pump action of each intensifier cylinder pump 20, thereby elevating the product pressure even beyond the pressure of the hydraulic system 22.

The final element in the product system 50 is an interaction chamber 60 that incorporates a pair of nozzles 62 in fluid communication with the pressurized product from each cylinder pump 20. The two nozzles 62, which are located within the interaction chamber 60 are in close proximity. While the two nozzles cross or combine again, two product stream collide with each other at high speed, creating a high pressure. The collision causes particle size reduction and the emulsifying process. The precisely timed flow overlap period from the alternating product cylinder pumps 20 produces a constant product flow-rate which eliminates large variances in pressure, thus achieving uniformity in product particle size leaving the nozzles 62.

Figure 5:
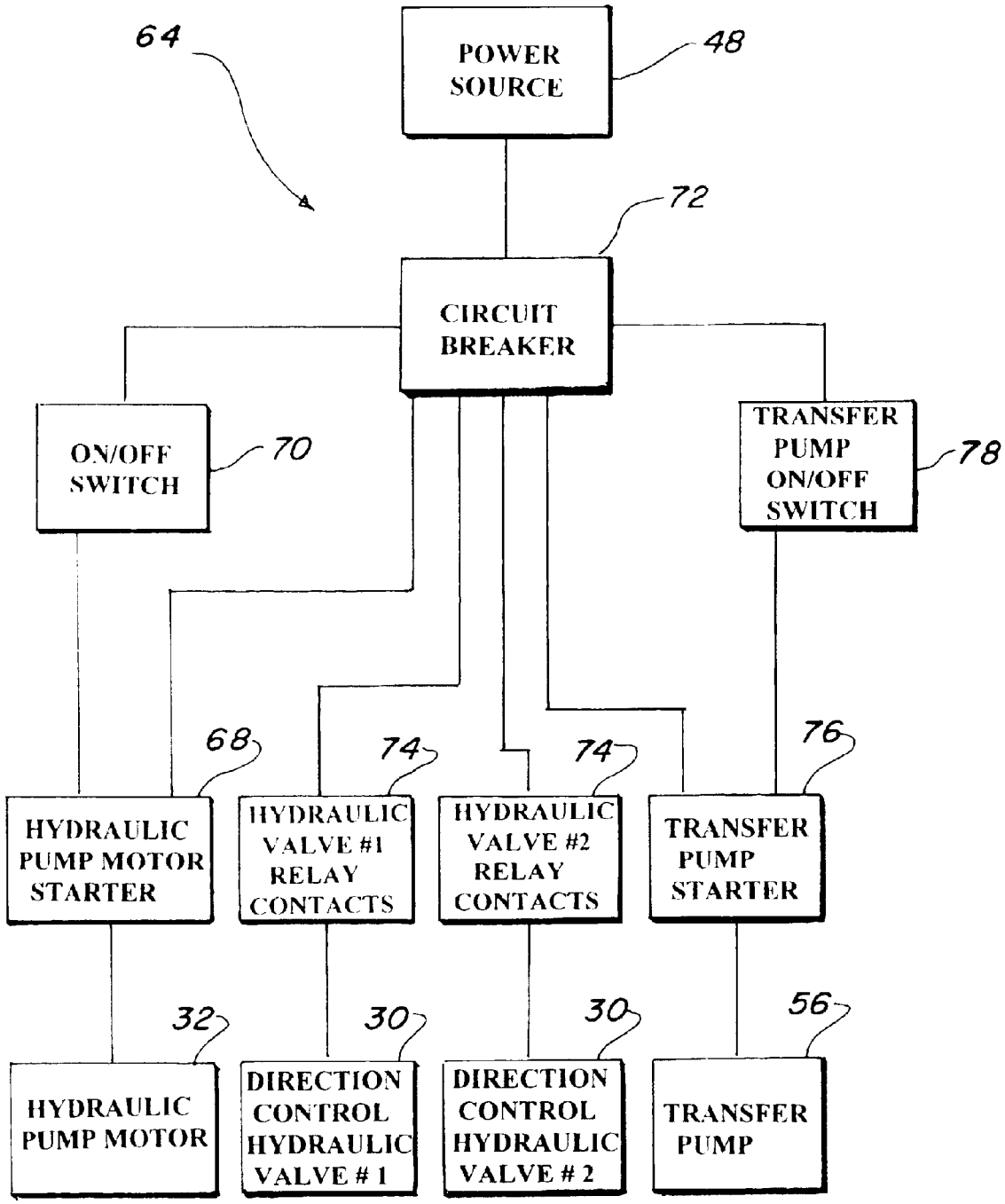
FIG. 5 is an electric power block diagram.

An electric power control system 64, as shown in FIG. 5, is required to operate the hydraulic system 22 and consists of the hydraulic pump motor 32 along with its requisite hydraulic pump motor starter 68 which includes the necessary motor protection and an on/off control switch 70. A circuit breaker 72 protects the system and a pair of hydraulic valve relays 74 having a coil and contacts control each hydraulic direction control valve 30. Optionally, a transfer pump starter 76 is normally required for the elective delivery transfer pump 56, as illustrated in FIG. 5. While the electric power control system 64 is described above it is not necessarily the only approach the actual control of the system as many other schemes and combinations may be used with equal success.

The process for utilizing the homogenizer to homogenize the product into uniform small particles is comprised of the following:

a) Compressing a product in a first single-acting product flow intensifier cylinder pump 20, with the pump mechanically driven by a hydraulic system 22.

b) Discharging the compressed product through the two nozzles 62 in the interaction chamber 60 for a timed interval.

c) Compressing the product in a second single-acting product flow intensifier cylinder pump 20 that is mechanically driven by a hydraulic system 22 at the precise time that the first intensifier pump 20 completes a power stroke with a controlled overlap period.

d) Discharging the compressed product through the two nozzles 62 in the interaction chamber 60 for a timed interval, and e) Timing the discharge of the first intensifier cylinder pump 20 through the two nozzles 62 relative to the second intensifier cylinder pump 20 through both nozzles 62 to produce sequential alternation, therefore supplying a constant product flow rate that approaches complete uniformity of particle size exiting the nozzles 62.

Figure 6:
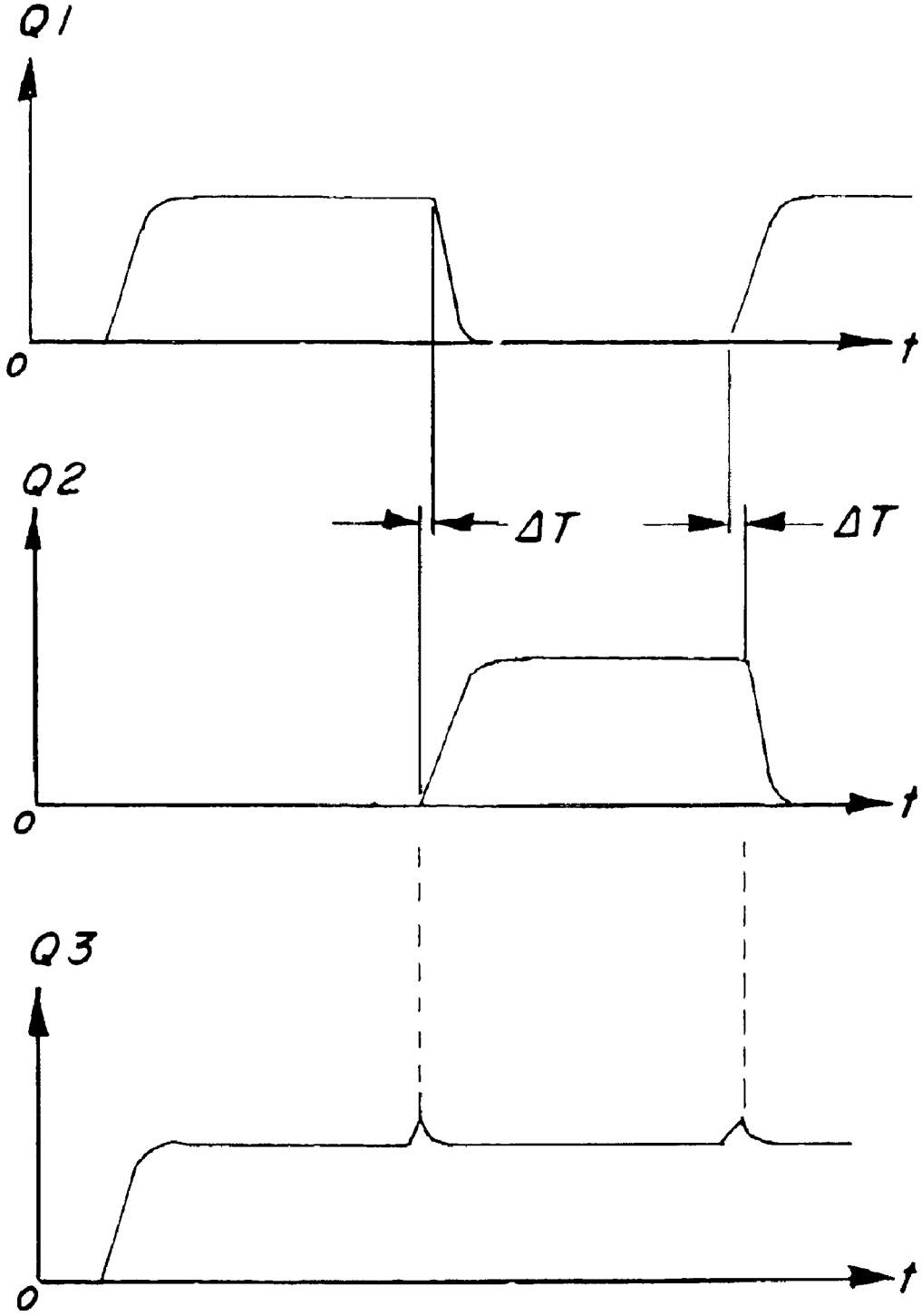
FIG. 6 is a product flow overlap diagram.

FIG. 6 illustrates the time verses pressure sequence of the two single-acting product flow intensifier cylinder pumps 20 relative to the overlap described above. The chart in FIG. 6 shows an x-y axis with t depicting time, Q depicting flow rate of the entering product into the nozzles 62. Q1 is for the first system, Q2 for the second system and Q3 is the combination of flow rate Q1 and Q2 that is introduced through the reaction chamber 60. It can be clearly visualized how the timing of the overlap produces an almost perfect uniformity in product particle size.

To understand the sequence that produces the pressure uniformity, once started, pump one begins to move forward in the power stroke, while pump two remains at rest. When pump one activates a timer in the microprocessor 26, pump two starts and begins to move forward. When the timer reaches a predetermined time duration pump one changes direction and brings in product during the suction stroke. When pump one activates the second sensor A2, pump one stops. Since a pump moving in the power stroke takes more time than required for the suction stroke plus the time differential pump two remains moving forward in the power stroke. When the timer reaches predetermined differential pump two changes its moving direction and begins the suction stroke. When pump two activates the second sensor B2, it stops and waits for pump one to activate the first sensor A1. The cycle will continue to alternate until the process is stopped. After stopping, the first sensors activated by the pumps will activate the timer but will no longer activate another pump which will come to rest.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A uniform small particle homogenizer for a liquid product comprising:

a) a hydraulic system having a pair of hydraulic cylinders and a direction control valve in communication with each hydraulic cylinder, which activates each cylinder in an opposed reciprocating sequence, b) a pair of single-acting product flow intensifier cylinder pump pumps driven by the hydraulic system, wherein each of the intensifier cylinder pumps have a power stroke side and a suction stroke side, and are each rigidly affixed onto each hydraulic cylinder such that wherein when the hydraulic cylinder reciprocates linear action is transferred to the intensifier cylinder pumps, c) a pair of proximity sensors interfacing with each intensifier cylinder pumps detecting forward and rearward position, d) a product reservoir in fluid communication through an inlet check valve to each product flow intensifier cylinder pump, which provides a liquid product thereunto, e) a outlet check valve connected to each intensifier cylinder pump, thus creating a pump action of the liquid product form each intensifier cylinder pump to elevate the product pressure, and f) an interaction chamber having at least a pair of nozzles in fluid communication with the pressurized product form both cylinder pumps, wherein said opposed action of the product cylinder pumps produced a constant product flow rate that approaches complete uniformity of particle size sequentially exiting the nozzles, and g) an electronic microprocessor control system having means for monitoring and regulating the reciprocating sequence of the hydraulic cylinders, timing means for controlling the sequential operation of each intensifier cylinder pump such that the power stroke of each cylinder pump is timed to alternately produce a flow of product through the pump with a precisely timed flow overlap period from alternating pumps since the power stroke takes a longer time than the suction stroke, control by the microprocessor of the instant each alternating power stroke is started, a constant product flow-rate entering the interaction chamber is achieved to eliminate large variances in pressure therefore achieving uniformity in product particle size.

2. The uniform small particle homogenizer as recited in claim 1 wherein said hydraulic system further comprises a single electric motor driving a variable displacement hydraulic pump in fluid communication through a supply line to each single-acting hydraulic cylinder, a return line strainer located within a hydraulic return line from each hydraulic cylinder, a single reservoir collecting hydraulic fluid from each hydraulic cylinder return line and a strainer located within a supply line from the hydraulic pump.

3. The uniform small particle homogenizer as recited in claim 1 wherein said direction control valve comprises a four-way, sliding bobbin type having an off position and two opposed direction positions.

4. The uniform small particle homogenizer as recited in claim 1 wherein said electronic microprocessor control system further comprises a discrete microprocessor that regulates the reciprocating sequence of the hydraulic cylinders by cycling said direction control valves, wherein a plurality of sensors detect the position of the hydraulic cylinders and signal the microprocessor control system to energize the hydraulic cylinders at a precise interval to produce contact flow of the pressurized product and to optimize flow overlap.

5. The uniform small particle homogenizer as recited in claim 1 wherein each product flow intensifier cylinder pump is smaller in working area than the hydraulic cylinder, thus permitting a pressure increase.

6. The uniform small particle homogenizer as recited in claim 1 further comprising an optional delivery transfer pump in communication with said product reservoir and each inlet check valve to increase inlet pressure to the intensifier cylinder pump and overcome line pressure loss and resistance of the inlet check valve.

7. The uniform small particle homogenizer as recited in claim 1 wherein said nozzles located within said interaction chamber are in close proximity.

8. The uniform small particle homogenizer as recited in claim 1 further comprising electric power control having a hydraulic pump motor with a starter, motor protection and on/off control for operating a pair of hydraulic direction control valve relays for each hydraulic direction control valve and a starter for an optional delivery transfer pump.

9. A process for homogenizing a liquid product into uniform small particles comprising the steps of:

a) compressing a product in a first single-acting product flow intensifier cylinder pump mechanically driven by a hydraulic system, b) compressing the product in a second single-acting product flow intensifier cylinder pump that is mechanically driven by a hydraulic system at the precise time that the first intensifier pump completes a power stroke with a controlled overlap period, c) discharging the compressed product from the first cylinder pump through interaction chamber nozzles, for a timed interval, d) discharging the compressed product from the second cylinder pump through interaction chamber nozzles, for a timed interval, and e) timing the discharge of the first intensifier cylinder pump through the interaction chamber nozzles relative to the second intensifier cylinder pump through the same interaction chamber, valve or orifice to produce sequential alternation, therefore supplying a constant product flow rate approaching complete uniformity of particle size exiting the nozzles.

* * * * *